US011723425B2

(12) United States Patent
Pengov

(10) Patent No.: US 11,723,425 B2
(45) Date of Patent: Aug. 15, 2023

(54) DECORATIVE SYSTEMS THAT INCLUDE AN ELONGATED DECORATIVE ELEMENT AND ASSOCIATED METHODS OF MANUFACTURE AND USE

(71) Applicant: Christopher P. Pengov, Marblehead, OH (US)

(72) Inventor: Christopher P. Pengov, Marblehead, OH (US)

( * ) Notice: Subject to any disclaimer, the term of this patent is extended or adjusted under 35 U.S.C. 154(b) by 0 days.

(21) Appl. No.: 17/721,423

(22) Filed: Apr. 15, 2022

(65) Prior Publication Data

US 2022/0338582 A1 Oct. 27, 2022

Related U.S. Application Data

(60) Provisional application No. 63/178,146, filed on Apr. 22, 2021.

(51) Int. Cl.
*A41G 1/04* (2006.01)
*F21S 4/10* (2016.01)

(52) U.S. Cl.
CPC . *A41G 1/04* (2013.01); *F21S 4/10* (2016.01)

(58) Field of Classification Search
CPC ..... A41G 1/04; F21S 4/10; F21V 21/22
See application file for complete search history.

(56) References Cited

U.S. PATENT DOCUMENTS 1,256,232 A 2/1918 Howard
1,878,447 A 9/1932 Sutphen
4,068,118 A 1/1978 Carrington
4,331,720 A * 5/1982 Vin Dick ..... A47G 33/06 428/9
4,462,065 A 7/1984 Rhodes
5,383,296 A 1/1995 Vecchione et al.
5,712,002 A * 1/1998 Reilly, III ..... A47G 33/06 428/20
5,820,248 A 10/1998 Ferguson
6,048,590 A * 4/2000 Phillips ..... A47G 33/06 428/20
6,056,427 A 5/2000 Kao
6,457,839 B1 10/2002 Grandoit
6,527,413 B1 3/2003 McIngvale
6,779,906 B1 8/2004 Delmar
8,485,690 B1 7/2013 Garcia et al.
9,593,831 B2 3/2017 Yu
(Continued)

*Primary Examiner* — Leah Simone Macchiarolo
(74) *Attorney, Agent, or Firm* — MacMillan, Sobanski & Todd, LLC

(57) ABSTRACT

Decorative systems that include an elongated decorative element and associated methods of manufacture and use are described. An example decorative system has a frame and an elongated decorative element attached to the frame. The frame has a first end, a second end, a length, and a main body that defines a slot and a central passageway. The slot provides access to the central passageway. The frame is moveable between a first configuration and a second configuration. The slot has a first width when the frame is in the first configuration and a second width when the frame is in the second configuration. The second width is greater than the first width. The first elongated decorative element has a first end, a second end, and a length. The length of the first elongated decorative element is greater than the length of the frame.

20 Claims, 6 Drawing Sheets

(56) References Cited

U.S. PATENT DOCUMENTS

| | | | | |
|---|---|---|---|---|
| 9,797,584 | B2 | 10/2017 | Andretta-Pulera | |
| 10,584,859 | B2 | 3/2020 | Hoelscher | |
| 10,641,470 | B1 | 5/2020 | Smyth | |
| 10,765,245 | B2 | 9/2020 | Loomis | |
| 11,096,510 | B2 * | 8/2021 | Tucker | A47G 33/06 |
| 2004/0083633 | A1 | 5/2004 | Mueller | |
| 2007/0008724 | A1 | 1/2007 | Raska | |
| 2007/0041189 | A1 | 2/2007 | Mchinnis et al. | |
| 2008/0283717 | A1 * | 11/2008 | Kim | A41G 1/007<br>248/524 |
| 2010/0269384 | A1 | 10/2010 | Whelan | |
| 2017/0114988 | A1 | 4/2017 | Andretta-Pulera | |
| 2018/0058648 | A1 | 3/2018 | Fang | |
| 2020/0208794 | A1 | 7/2020 | Stange | |

* cited by examiner

DECORATIVE SYSTEMS THAT INCLUDE AN ELONGATED DECORATIVE ELEMENT AND ASSOCIATED METHODS OF MANUFACTURE AND USE

RELATED APPLICATION

This application claims priority to U.S. Provisional Application No. 63/178,146, filed Apr. 22, 2021. The entire contents of this related application are hereby incorporated by reference into this disclosure.

FIELD

The disclosure relates generally to the field of decorations. More particularly, the disclosure relates to decorative systems that include an elongated decorative element and associated methods of manufacture and use.

BACKGROUND

Conventionally, an elongated decorative element is directly attached to a support structure by wrapping the elongated decorative element around the support structure multiple times and then securing the elongated decorative element directly to the support structure. For example, a strand of light emitting elements is generally attached to a vertical structure, such as a pole or tree, by wrapping the strand around the vertical structure multiple times and securing the strand to the vertical structure. Stands of garland are generally attached to vertical structures using the same process. These processes, however, are time consuming, inefficient, and can be difficult to accomplish, depending on the size and location of the support structure to which the elongated decorative element is intended to be attached.

A need exists, therefore, for new and useful decorative systems that include an elongated decorative element and associated methods of manufacture and use that address these deficiencies.

SUMMARY OF SELECTED EXAMPLE EMBODIMENTS

Various examples of decorative systems that include an elongated decorative element and associated methods of manufacture and use are described herein.

An example decorative system has a frame and an elongated decorative element. The frame has a first end, a second end, a length that extends from the first end of the frame to the second end of the frame, and a main body that defines a slot and a central passageway. Each of the slot and the central passageway extends from the first end of the frame to the second end of the frame. The slot provides access to the central passageway. The frame is moveable between a first configuration and a second configuration. The slot has a first width when the frame is in the first configuration and a second width when the frame is in the second configuration. The second width is greater than the first width. The first elongated decorative element is attached to the frame. The first elongated decorative element has a first end, a second end, and a length that extends from the first end of the first elongated decorative element to the second end of the first elongated decorative element. The length of the first elongated decorative element is greater than the length of the frame.

An example method of manufacturing a decorative system includes: obtaining a frame that has a first end, a second end, and defines a central passageway; incorporating a slot into the frame that extends from the first end of the frame to the second end of the frame and provides access to the central passageway; incorporating a plurality of attachment member passageways into the frame; obtaining a plurality of attachment members; positioning a first attachment member of the plurality of attachment members oi the frame at the first end of the frame; obtaining an elongated decorative element; positioning the elongated decorative element on the frame and adjacent the first attachment member of the plurality of attachment members; attaching the elongated decorative element to the frame using the first attachment member of the plurality of attachment members; positioning a second attachment member of the plurality of attachment members on the frame at the second end of the frame; positioning the elongated decorative element on the frame and adjacent the second attachment member of the plurality of attachment members; attaching the elongated decorative element to the frame using the second attachment member of the plurality of attachment members.

An example method of using a decorative system includes: obtaining a decorative system, the decorative system comprises a frame, an elongated decorative element, and a plurality of attachment members, the frame defines a slot and a central passageway; selecting a support structure onto which the decorative system is to be releasably attached; positioning the decorative system adjacent to the support structure; moving the frame of the decorative system from a first configuration to a second configuration; passing the support structure through the slot and into the central passageway defined by the frame while the frame is in the second configuration; and moving the frame of the decorative system from the second configuration to the first configuration such that the decorative element is releasably attached to the support structure.

Additional understanding of the example decorative systems that include an elongated decorative element, methods of manufacturing a decorative system, and methods of using a decorative system can be obtained by review of the detailed description, below, and the appended drawings.

DETAILED DESCRIPTION

Figure 1:
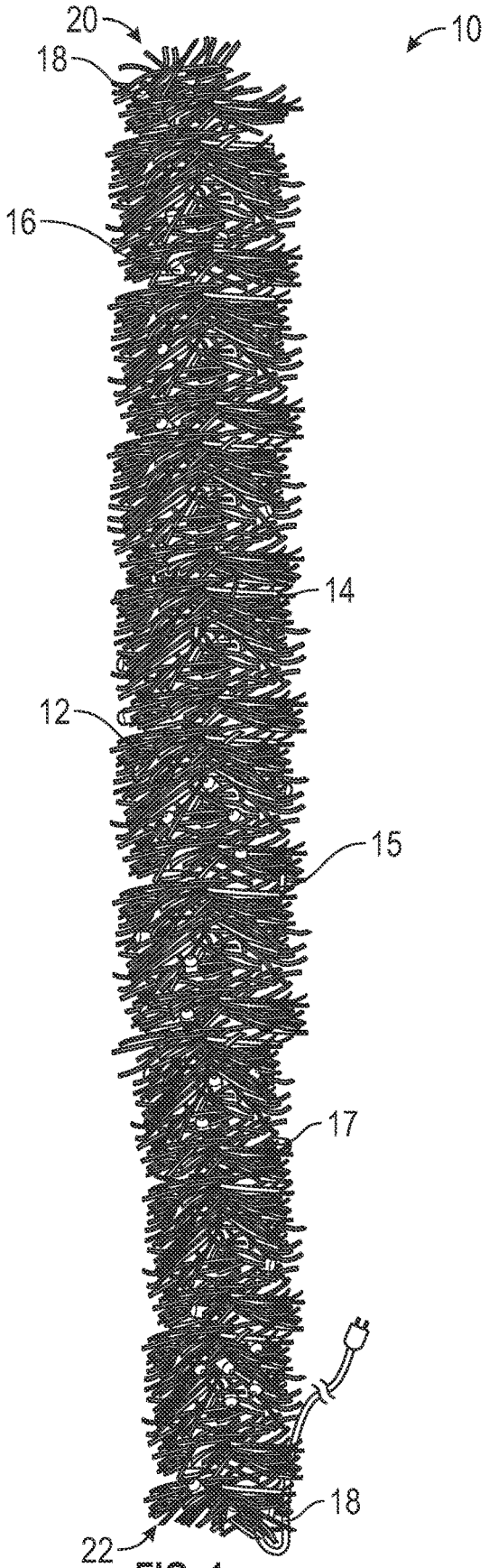
FIG. 1 is a front view of an example decorative system that includes an elongated decorative element.

The following detailed description and the appended drawings describe and illustrate various example embodiments of decorative systems that include an elongated decorative element, methods of manufacturing a decorative system, and methods of using a decorative system. The description and illustration of these examples are provided to enable one skilled in the art to make and use a decorative system that includes an elongated decorative element, to practice a method of manufacturing a decorative system, and to practice a method of using a decorative system. They are not intended to limit the scope of the claims in any manner. The invention is capable of being practiced or carried out in various ways and the examples described and illustrated herein are merely selected examples of the various ways of practicing or carrying out the invention and are not considered exhaustive.

As used herein, the term "diameter" refers to the length of a straight line passing through the center of a body, element, or feature from one surface of the body, element, or feature, to another surface of the body, element, or feature and does not impart any structural configuration on the body, element, or feature.

FIGS. 1 through 7 illustrate a first example decorative system 10 that includes a frame 12, a first elongated decorative element 14, a second elongated decorative element 16, and a plurality of attachment members 18.

Figure 2:
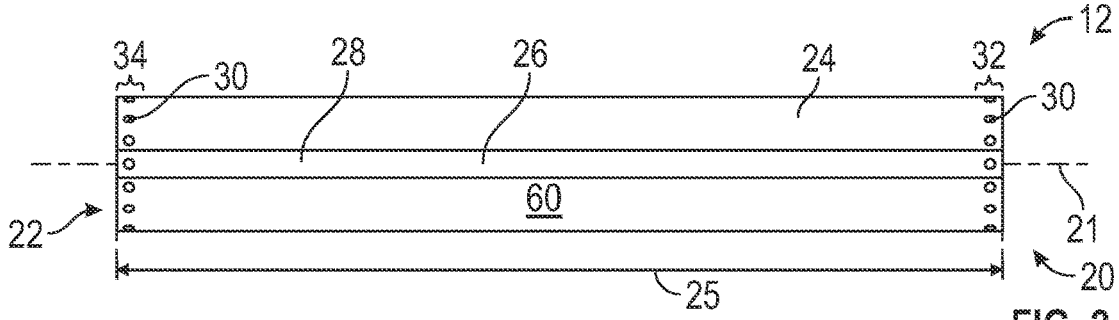
FIG. 2 is an elevation view of the frame of the decorative system illustrated in FIG. 1.
Figure 5:
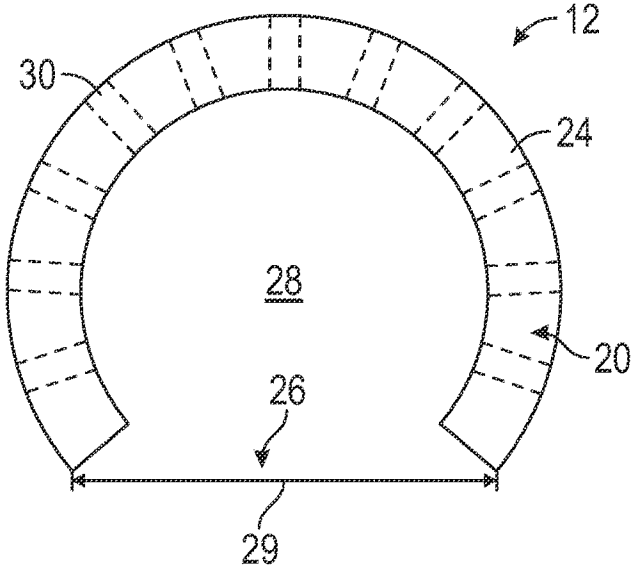
FIG. 5 is a top view of the frame illustrated in FIG. 2 in the second configuration.
Figure 4:
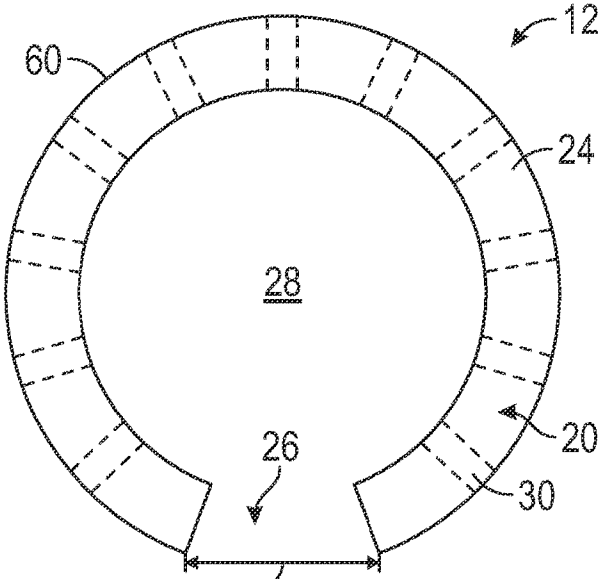
FIG. 4 is a top view of the frame illustrated in FIG. 2 in the first configuration.

In the illustrated embodiment, the frame 12 is moveable between a first configuration, as shown in FIGS. 2 and 4, and a second configuration, as shown in FIG. 5. The frame 12 has a first end 20, a second end 22, a lengthwise axis 21, a main body 24, and a length 25. The main body 24 defines a slot 26, a central passageway 28, and a plurality of attachment member passageways 30. Each of the slot 26 and the central passageway 28 extends from the first end 20 to the second end 22. The slot 26 provides access to the central passageway 28. The slot 26 is sized such that a support structure can be passed through the slot 26 and disposed within the central passageway 28. The slot 26 has a first width 27 when the frame 12 is in the first configuration, as shown in FIG. 4, and a second width 29 when the frame is in the second configuration, as shown in FIG. 5. The second width 29 is greater than the first width 27, which allows for a support structure to be passed through the slot 26 and into the central passageway 28. In the illustrated embodiment, the first width 27 can be any suitable width. Examples of widths considered suitable for a first width of a slot include widths between about 0.1 includes and about 1.5 inches, widths greater than, less than, or equal to 1.5 inches, widths greater than, less than, or equal to 1 inch, and any other width considered suitable for a particular embodiment.

Each attachment member passageway of the plurality of attachment member passageways 30 extends through the main body 24 and provides access to the central passageway 28. A first set of attachment member passageways 32 of the plurality of attachment member passageways 30 is disposed adjacent the first end 20 (e.g., less than 5 inches from the first end 20, less than 1 inch from the first end 20) and a second set of attachment member passageways 34 of the plurality of attachment member passageways 30 is disposed adjacent to the second end 22 (e.g., less than 5 inches from the second end 22, less than 1 inch from the second end 22). The first set of attachment member passageways 32 is disposed between the first end 20 and the second set of attachment member passageway 34. The second set of attachment member passageways 34 is disposed between the second end 22 and the first set of attachment member passageway 32.

A frame included in a decorative system can have any suitable structural arrangement and be formed of any suitable material and selection of a suitable structural arrangement and material for a frame can be based on various considerations, including the number of elongated decorative elements intended to be attached to a frame. Examples of structural arrangements considered suitable for a frame include tubular members, elongated tubular members, tubular members that define any suitable central passageway, or exterior surface, cross-sectional shape, such as circular, square, rectangular, and any other structural arrangement considered suitable for a particular embodiment. Examples of materials considered suitable to form a frame include metals, alloys, polymers, polyvinyl chloride (PVC), wire mesh, injection molded materials, and any other material considered suitable for a particular embodiment. In the illustrated embodiment, the frame 12 is a tubular member formed of PVC. Optionally, depending on the material forming a frame, the edges of a frame that define a slot can be rounded to prevent damage to a support structure during attachment of a decorative system to the support structure and/or the edges of a frame that define a passageway can be rounded to prevent damage to a decorative element during attachment of a decorative elements to the frame. In alternative embodiments, a frame can be formed of multiple pieces of material that can be releasably attached to one another. For example, a frame can be formed of a first portion and a second portion that is releasably attachable to the first portion such that the overall length of the frame can be adjusted to a length that corresponds to a length of a support structure to which the decorative system is being attached. The second portion can be positioned along any suitable portion of the length of the first portion prior to attachment such that the frame length is adjustable.

While the frame 12 has been illustrated as including a plurality of attachment member passageways 30 disposed at particular locations on the frame, a frame can include any suitable number of attachment member passageways disposed at any suitable location on a frame. Selection of a suitable number of attachment member passageways and of a suitable location to position an attachment member passageway can be based on various considerations, including the type of elongated decorative element intended to be attached to the frame. For example, a frame can include attachment member passageways adjacent to a first end of a frame, adjacent to a second end of a frame, between a first end of a frame and a second set of attachment member passageways, between a first set of attachment member passageways and a first end of a frame, between a first set of attachment members passageways and a second set of attachment member passageways, between a first end of a frame and a second end of the frame, and any other location considered suitable for a particular embodiment.

Figure 3:
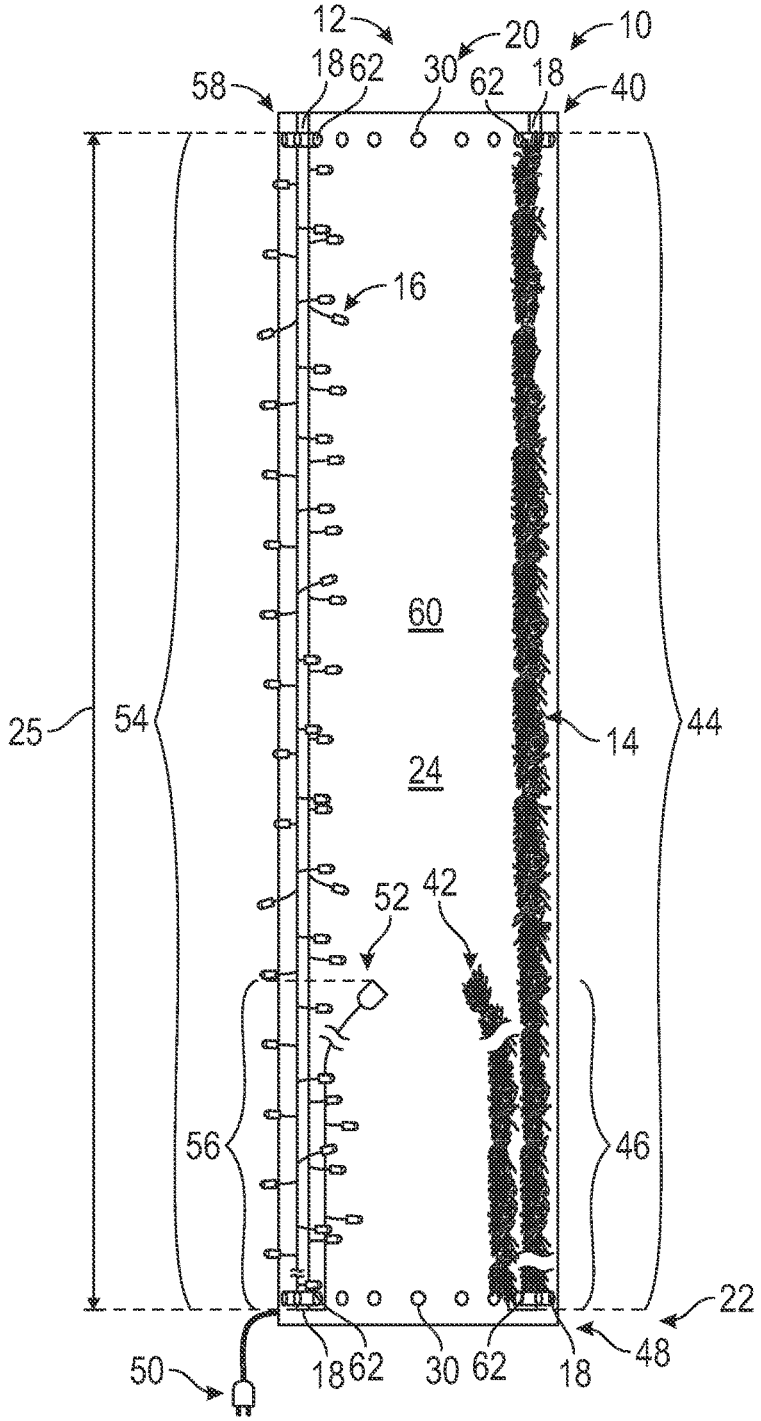
FIG. 3 is a partial flat plan view of the decorative system illustrated in FIG. 1.
Figure 6:
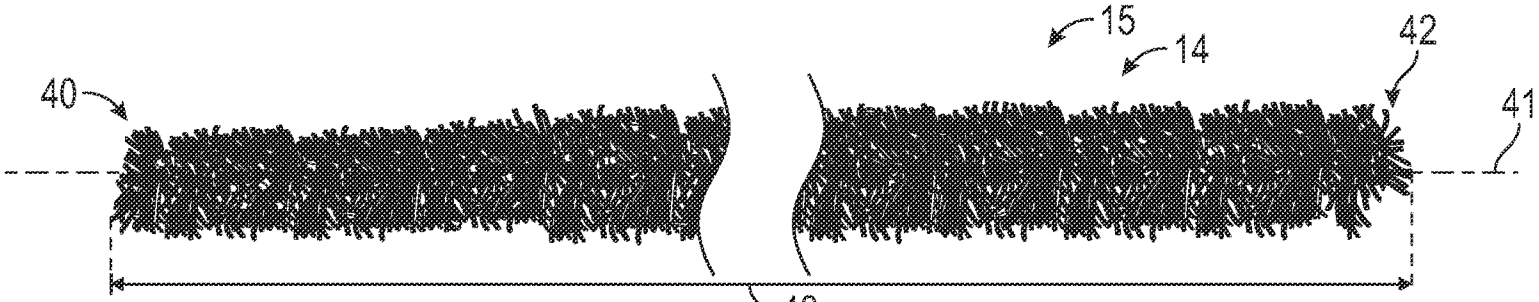
FIG. 6 is a partial perspective view of a first elongated decorative element of the decorative system illustrated in FIG. 1.

The first elongated decorative element 14 is attached to the frame 12 in more than one location using the plurality of attachment members 18. However, alternative embodiments can include an elongated decorative element that is attached to a frame in only one location. As shown in FIG. 6, the first elongated decorative element 14 has a lengthwise axis 41, first end 40, a second end 42, and a length 43 that extends from the first end 40 to the second end 42. The first end 40 of the first elongated decorative element 14 is fixed relative to the frame 12, as shown in FIG. 3. The length 43 of the first elongated decorative element 14 is greater than the length 25 of the frame 12 (e.g., as shown in FIG. 6 when the first elongated decorative element 14 is free of the frame 12 and disposed along its lengthwise axis 41). As shown in FIGS. 1 and 3, a first portion 44 of the first elongated decorative element 14 extends along the length 25 of the frame 12 and a second portion 46 of the first elongated decorative element 14 extends along the length 25 of the frame 12. The first elongated decorative element 14 extends from the first end 40 of the first elongated decorative element 14 toward an end (e.g., first end 20, second end 22) of the frame 12, defines a curve 48, and extends toward the other end (e.g., first end 20, second end 22) of the frame 12. The curve 48 is defined between an attachment member passageway of the plurality of attachment member passageways 30 and an end (e.g., first end 20, second end 22) of the frame 12. However, depending on the length of an elongated decorative element, any suitable number of portions of an elongated decorative element can extend along a length of a frame and an elongated decorative element can define any suitable number of curves. In the embodiment illustrated, a majority of the length 43 of the first elongated decorative element 14 is disposed on the frame 12. More particularly, a majority of the length 43 of the first elongated decorative element 14 is disposed between the first end 20 of the frame 12 and the second end 22 of the frame 12. However, alternative embodiments can include an elongated decorative element that is only partially disposed on a frame, that is entirely disposed on a frame, or such that a minority of a length of a second elongated decorative element is disposed on a frame.

Figure 7:
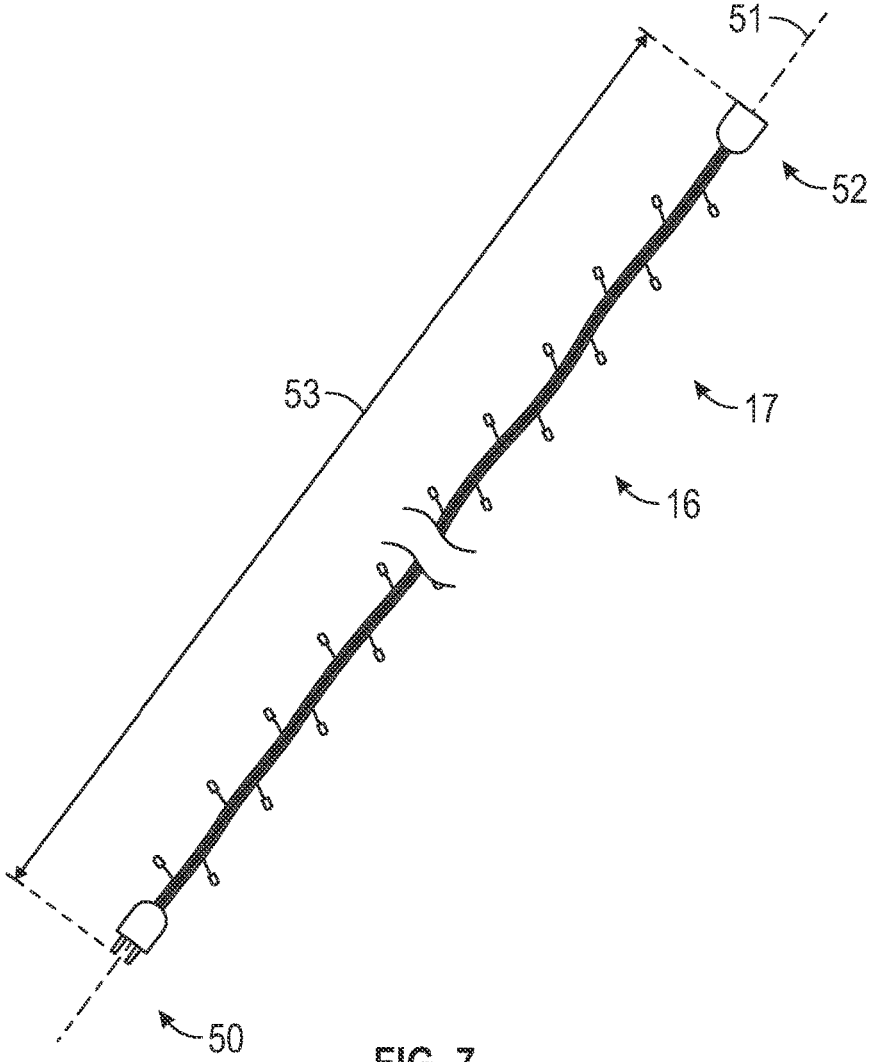
FIG. 7 is a partial perspective view of a second elongated decorative element of the decorative system illustrated in FIG. 1.

The second elongated decorative element 16 is attached to the frame 12 in more than one location using the plurality of attachment members 18. However, alternative embodiments can include an elongated decorative element that is attached to a frame in only one location. As shown in FIG. 7, the second elongated decorative element 16 has a lengthwise axis 51, first end 50, a second end 52, and a length 53 that extends from the first end 50 to the second end 52. The first end 50 of the second elongated decorative element 16 is moveable relative to the frame 12 such that is can be attached to a power outlet. However, depending on the type of elongated decorative element included in a decorative system, a first end may not need to be moveable relative to a frame. The length 53 of the first elongated decorative element 14 is greater than the length 25 of the frame 12 (e.g., as shown in FIG. 7 when the second elongated decorative element 16 is free of the frame 12 and disposed along its lengthwise axis 51). As shown in FIGS. 1 and 3, a first portion 54 of the second elongated decorative element 16 extends along the length 25 of the frame 12 and a second portion 56 of the second elongated decorative element 16 extends along the length 25 of the frame 12. The second elongated decorative element 16 extends from the first end 50 of the second elongated decorative element 16 toward an end (e.g., first end 20, second end 22) of the frame 12, defines a curve 58, and extends toward the other end (e.g., first end 20, second end 22) of the frame 12. The curve 58 is defined between an attachment member passageway of the plurality of attachment member passageways 30 and an end (e.g., first end 20, second end 22) of the frame 12. However, depending on the length of an elongated decorative element, any suitable number of portions of an elongated decorative element can extend along a length of a frame and an elongated decorative element can define any suitable number of curves. In the embodiment illustrated, a majority of the length 53 of the second elongated decorative element 16 is disposed on the frame 12. More particularly, a majority of the length 53 of the second elongated decorative element 16 is disposed between the first end 20 of the frame 12 and the second end 22 of the frame 12. However, alternative embodiments can include an elongated decorative element that is only partially disposed on a frame, is entirely disposed on a frame, or such that a minority of a length of a first elongated decorative element is disposed on a frame.

In the illustrated embodiment, the frame 12 has an exterior surface 60 that has a first color and the first elongated decorative element 14 has a second color that is substantially similar to the first color. This arrangement provides a mechanism to disguise, or camouflage, the frame 12. A frame and an elongated decorative element can have any suitable color, which can be applied to a frame or elongated decorative element in any suitable manner. Selection of a suitable color for a frame and an elongated decorative element can be based on various considerations, including the intended use of a decorative system of which a frame and an elongated decorative element are components. Alternative embodiments, however, can include a frame that has an exterior surface that has a first color that is different than the second color of an elongated decorative element.

A first elongated decorative element and a second elongated decorative element can comprise any suitable elongated decorative element, having any suitable structural arrangement, and formed of any suitable material. Selection of a suitable elongated decorative element to include in a decorative system can be based on various considerations, including the intended use of the decorative system. Examples of decorative elements, such as elongated decorative elements, considered suitable to include in a decorative system include strands of light emitting elements, strands of garland, lighted stands of garland, strands of tinsel, lighted strands of tinsel, strands of decorative elements (e.g., holiday decorations, such as pumpkins, flags, hearts), holiday decorative elements (e.g., pine cones, flags, pumpkins, hearts, four-leaf clovers), seasonal decorative elements, those desired by a user, and any other decorative elements considered suitable for a particular embodiment. In the illustrated embodiment, the first elongated decorative element 14 is a strand of garland 15 and the second elongated decorative element 16 is a strand of light emitting elements 17.

While the decorative system has been illustrated as including a first elongated decorative element 14 and a second elongated decorative element 16, a decorative system can include any suitable number of elongated decorative elements and selection of a suitable number of elongated decorative elements to include in a decorative system can be based on various considerations, including the intended use of the decorative system. Examples of numbers of decorative elements, such as elongated decorative elements, considered suitable to include in a decorative system include one, more than one, two, a plurality, three, four, five, more than five, and any other number considered suitable for a particular embodiment.

An attachment member included in a decorative system can comprise any suitable feature, device, or component capable of providing attachment (e.g., releasable attachment, fixed attachment) between two components (e.g., a frame and an elongated decorative element) and selection of a suitable attachment member can be based on various considerations, including the type of attachment desired between two components. Examples of attachment members considered suitable to include in a decorative system include any suitable connector, such as threaded connectors, fasteners, cable ties, adhesives, hooks, pin type snap-hook, push pin type snap hooks, combinations of those described herein, and any other attachment member considered suitable for a particular embodiment. In the illustrated embodiment, each attachment member of the plurality of attachment members 18 is a cable tie 62, and is described in more detail herein with respect to the method of manufacture.

Figure 8:
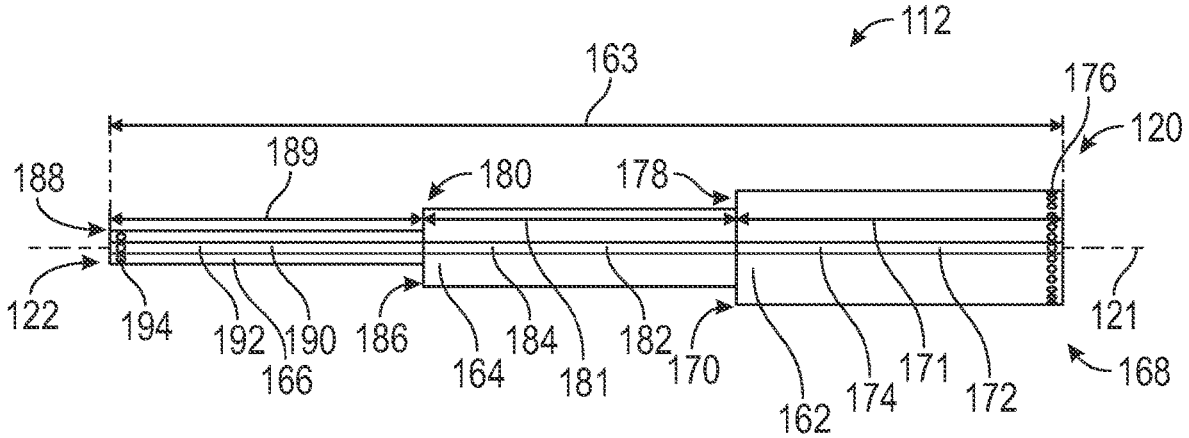
FIG. 8 is an elevation view of an alternative frame that can be included in a decorative system. The frame is illustrated in the extended configuration.
Figure 9:
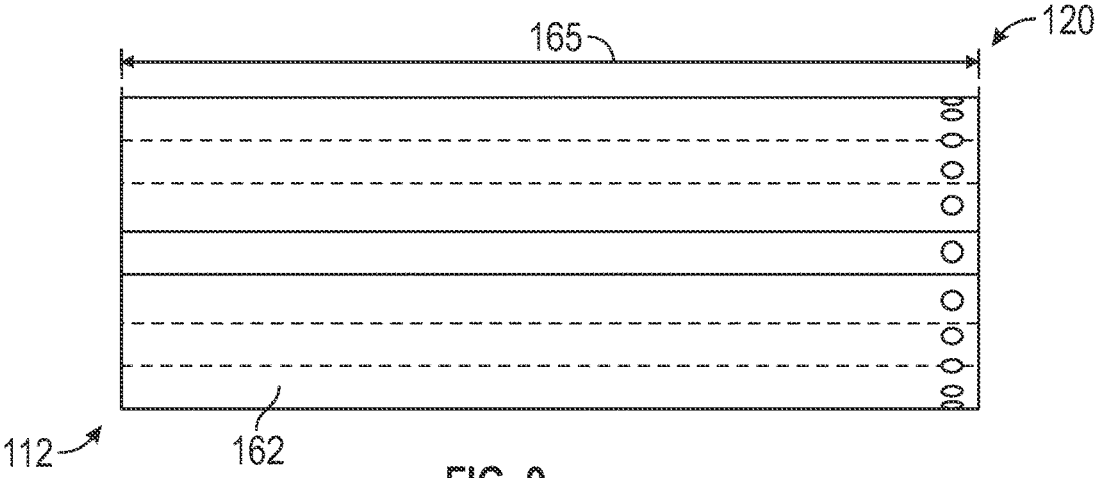
FIG. 9 is another elevation view of the frame illustrated in FIG. 8. The frame is illustrated in the collapsed configuration.

FIGS. 8 and 9 illustrate an alternative frame 112 that can be included in a decorative system. The frame 112 is similar to the frame 12 illustrated in FIGS. 1, 2, 3, 4, and 5, except as detailed below.

In the illustrated embodiment, the frame 112 comprises a telescopic frame that is moveable between an extended configuration, as shown in FIG. 8, and a collapsed configuration, as shown in FIG. 9. In addition, the frame 112 is moveable between a first configuration and a second configuration, as described herein. The frame 112 has a first end 120, a second end 122, a lengthwise axis 121, a first main body 162, a second main body 164, a third main body 166, a first length 163, and a second length 165. The first length 163 is greater than the second length 165.

The first main body 162 has a first end 168, a second end 170, a length 171, and defines a slot 172, a central passageway 174, and a plurality of attachment member passageways 176. Each of the slot 172 and the central passageway 174 defined by the first main body 162 extends from the first end 168 to the second end 170. The slot 172 provides access to the central passageway 174. The slot 172 is sized such that a supporting structure can be passed through the slot 172 and disposed within the central passageway 174. The central passageway 174 is sized to receive a portion of a support structure and each of the second main body 164 and the third main body 166. Each attachment member passageway of the plurality of attachment member passageways 176 extends through the first main body 162, provides access to the central passageway 174, and is disposed adjacent the first end 120 of the frame 112. Each attachment member passageway of the plurality of attachment member passageways 176 defined by the first main body 162 is disposed between the first end 168 and the second end 170 of the first main body 162.

The second main body 164 is slideably attached to the first main body 162 within the central passageway 174 defined by the first main body 162. The second main body 164 has a first end 178, a second end 180, a length 181, and defines a slot 182, a central passageway 184. Each of the slot 182 and the central passageway 184 defined by the second main body 164 extends from the first end 178 to the second end 180. The slot 182 provides access to the central passageway 184. The slot 182 is sized such that a supporting structure can be passed through the slot 182 and disposed within the central passageway 184. The central passageway 184 is sized to receive a portion of a support structure and the third main body 166. In the extended configuration, a first portion of the length 181 of the second main body 164 is disposed within the central passageway 174 defined by the first main body 162. In the collapsed configuration, a second portion of the length 181 of the second main body 164 is disposed within the central passageway 174 defined by the first main body 162. The second portion is greater than the first portion.

The third main body 166 is slideably attached to the second main body 164 within the central passageway 184 defined by the second main body 164. The third main body 166 has a first end 186, a second end 188, a length 189, and defines a slot 190, a central passageway 192, and a plurality of attachment member passageways 194. Each of the slot 190 and the central passageway 192 defined by the third main body 166 extends from the first end 186 to the second end 188. The slot 190 provides access to the central passageway 192. The slot 190 is sized such that a supporting structure can be passed through the slot 190 and disposed within the central passageway 192. The central passageway 192 is sized to receive a portion of a support structure. In the extended configuration, a first portion of the length 189 of the third main body 166 is disposed within the central passageway 184 defined by the second main body 164. In the collapsed configuration, a second portion of the length 189 of the third main body 166 is disposed within the central passageway 184 defined by the second main body 164. The second portion is greater than the first portion. Each attachment member passageway of the plurality of attachment member passageways 194 extends through the third main body 166, provides access to the central passageway 192, and is disposed adjacent the second end 122 of the frame 112. Each attachment member passageway of the plurality of attachment member passageways 194 defined by the third main body 166 is disposed between the first end 186 and the second end 188 of the third main body 166.

While the frame 112 has been illustrated as including a first main body 162, a second main body 164, and a third main body 166, a. decorative system can include any suitable number of main bodies attached in any suitable manner to accomplish telescopic movement between the main bodies. Selection of a suitable number of main bodies to include in a frame, and of a suitable method to attach the main bodies to one another to accomplish telescopic movement, can be based on various considerations, including the size of a support structure to which a frame is intended to be attached and/or the material forming the main bodies. Examples of numbers of main bodies considered suitable to include in a frame include one, more than one, two, a plurality, three, four, five, more than five, and any other number considered suitable for a particular embodiment.

Various methods of manufacturing a decorative system and methods of using a decorative system are described herein. While the methods described herein are shown and described as a series of acts, it is to be understood and appreciated that the methods are not limited by the order of acts, as some acts may in accordance with these methods, occur in the order shown and/or described, in different orders, and/or concurrently with other acts described herein.

The below describes an example method of manufacturing a decorative system 200.

A step 202 comprises obtaining a frame that has a first end, a second end, and defines a central passageway. Another step 204 comprises incorporating a slot into the frame that extends from the first end of the frame to the second end of the frame and provides access to the central passageway. Another step 206 comprises incorporating a plurality of attachment member passageways into the frame. Another step 208 comprises obtaining a plurality of attachment members. Another step 210 comprises positioning a first attachment member of the plurality of attachment members on the frame at the first end of the frame. Another step 212 comprises obtaining an elongated decorative element. Another step 214 comprises positioning the elongated decorative element on the frame and adjacent the first attachment member of the plurality of attachment members. Another step 216 comprises attaching the elongated decorative element to the frame using the first attachment member of the plurality of attachment members. Another step 218 comprises positioning a second attachment member of the plurality of attachment members on the frame at the second end of the frame. Another step 220 comprises positioning the elongated decorative element on the frame and adjacent the second attachment member of the plurality of attachment members. Another step 222 comprises attaching the elongated decorative element to the frame using the second attachment member of the plurality of attachment members. Another step 224 comprises repeating step 210, step 212, step 214, step 216, step 218, step 220, and step 222 using additional attachment members and the elongated decorative element.

Step 202 can be accomplished by obtaining any suitable frame having any suitable cross-sectional shape or color. Examples of frames considered suitable to utilize to complete step 202 include frame 12, frame 112, and any other frame considered suitable for a particular embodiment.

Step 204 can be accomplished using any suitable cutting tool or by forming the frame with a pre-defined slot (e.g., using a molding process). A slot included on a frame can have any suitable width, such as those described herein.

Figure 10:
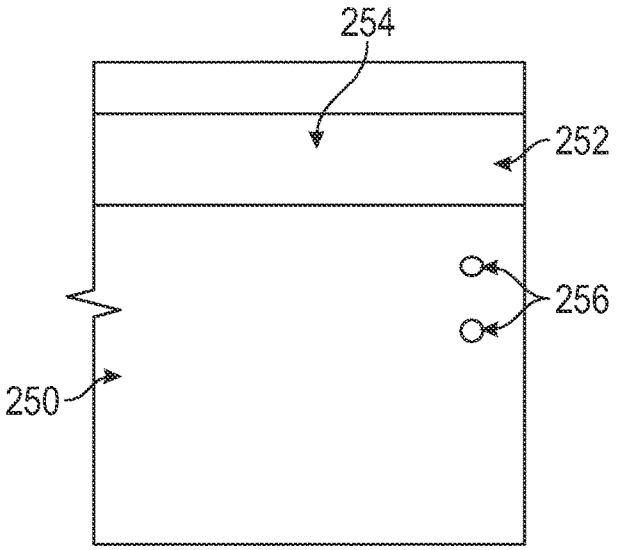
FIG. 10 is a partial perspective view of a frame of a decorative system free of any elongated decorative elements and attachment members.

Step 206 can be accomplished using any suitable drilling tool or by forming the frame with pre-defined attachment member passageways. When included, a plurality of attachment member passageways can be positioned at any suitable location on a frame. For example, a first set of attachment member passageways of the plurality of attachment member passageways can be disposed adjacent to the first end of the frame and a second set of attachment member passageways of the plurality of attachment member passageways can be disposed adjacent to the second end of the frame. Alternatively, a plurality of attachment member passageways can be omitted from a frame in embodiments in which an adhesive, for example, is being used at an attachment member. FIG. 10 shows an example frame 250 that includes a slot 252, a central channel 254, and a plurality of attachment member passageways 256.

Step 208 can be accomplished by obtaining any suitable attachment member, such as those described herein.

An optional step comprises painting the frame and can be completed prior to step 210.

Figure 11:
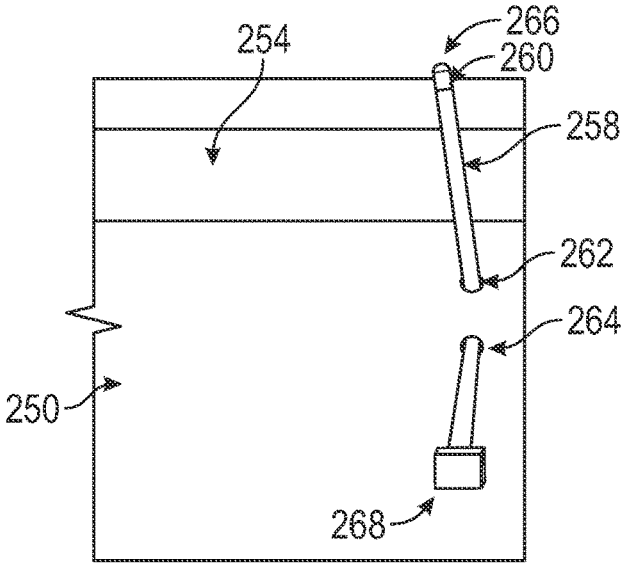
FIG. 11 is a partial perspective view of the frame illustrated in FIG. 10 and a first attachment member.

Step 210 can be accomplished using any suitable technique or method of positioning an attachment member on a frame and will depend on the structural arrangement of the frame and the type of attachment member being used. For example, FIG. 11 shows an attachment member 258 that comprises a cable tie 260 disposed through a first attachment member passageway 262 and a second attachment member passageway 264. The cable tie 260 has a first end 266 and a second end 268 disposed outside of the central channel 254 and a portion of the cable tie 260 is disposed within the central channel 254.

Step 212 can be accomplished using any suitable elongated decorative element, such as those described herein. Alternatively, a combination of first and second elongated decorative elements could be utilized to complete this method of manufacture.

Figure 12:
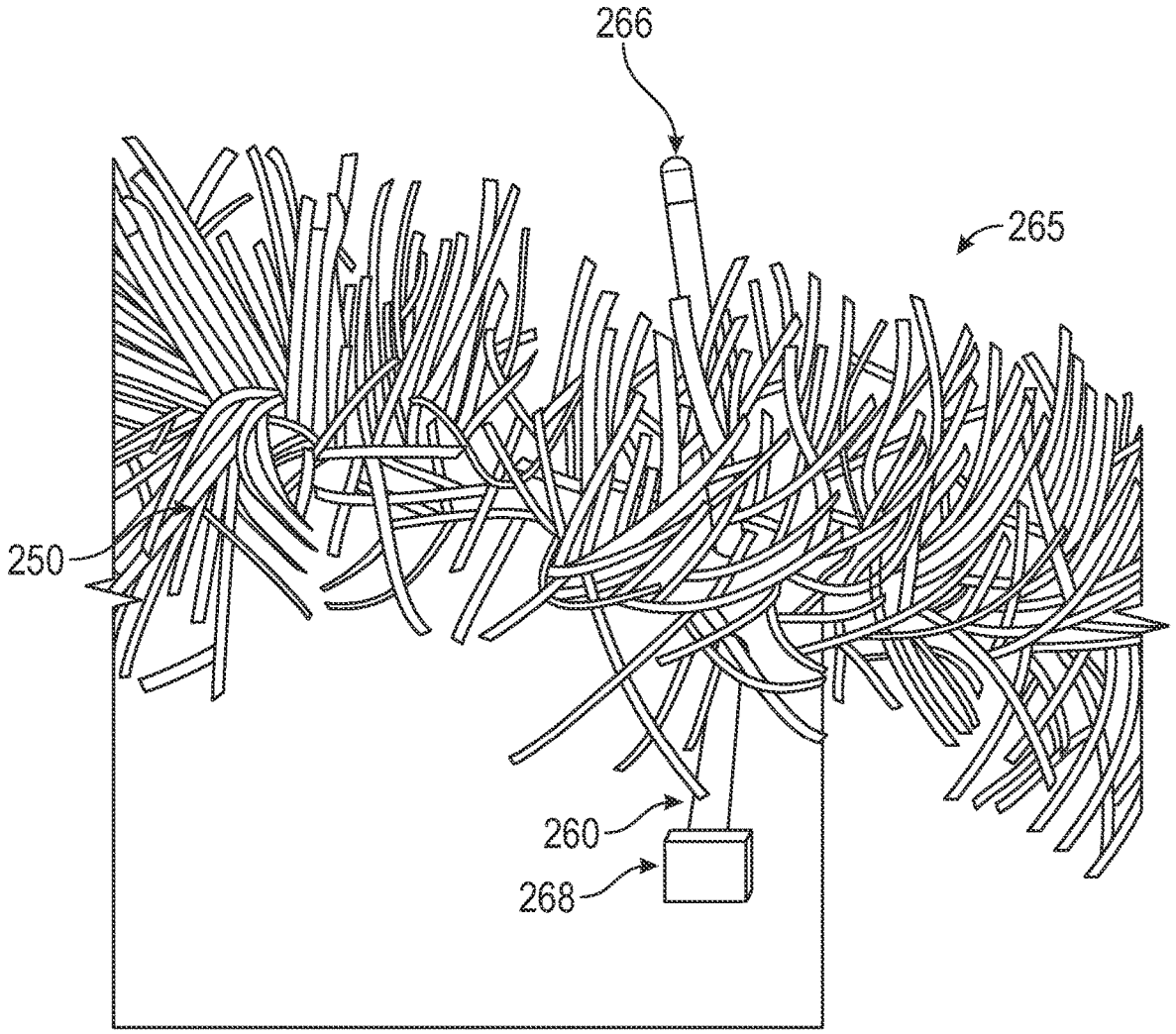
FIG. 12 is a partial perspective view of the frame and attachment member illustrated in FIG. 11 and a first elongated decorative element.

Step 214 can be accomplished using any suitable technique or method of positioning an elongated decorative element on the frame and adjacent to an attachment member and will depend on the type of attachment member and the type of elongated decorative element being used. For example, FIG. 12 shows a strand of garland 265 disposed on the frame 250 and adjacent the cable tie 260 such that the strand of garland 265 is disposed between the first and second ends 266, 268 of the cable tie 260.

Step 216 can be accomplished using any suitable technique or method of attaching an elongated decorative element to a frame and will depend on the type of attachment member and the type of elongated decorative element being used. For example, if a cable tie is being used, as shown in FIGS. 10, 11, and 12, the first end 266 of the cable tie 260 can be passed over the strand of garland 265, into a loop defined by the second end 268 of the cable tie 260, and pulled through the loop to accomplish attachment. Alternatively, if an attachment member comprises a hook, a portion of the elongated decorative element can be wrapped around the hook to accomplish attachment.

Step 218 can be accomplished as described in step 210, but relative to a second end of a frame.

Step 220 can be accomplished as described in step 214, but relative to a second attachment member. In completing this step, a curve is defined by the elongated decorative element adjacent the first end of the frame and the first attachment member as a result of the attachment accomplished in step 216.

Step 222 can be accomplished as described in step 216, but relative to a second attachment member.

Depending on the length of the frame being used and/or tie length of the elongated decorative element being used, step 224 can optionally be omitted from this method of manufacture. Alternatively, step 224 can be accomplished using a second elongated decorative element.

The below describes an example method of using a decorative system 300.

A step 302 comprises obtaining a decorative system. The decorative system comprises a frame, an elongated decorative element, and a plurality of attachment members. The frame defines a slot and a central passageway. Another step 304 comprises selecting a support structure onto which the decorative system is to be releasably attached. Another step 306 comprises positioning the decorative system adjacent to the support structure. Another step 308 comprises moving the frame of the decorative system from a first configuration to a second configuration. Another step 310 comprises passing the support structure through the slot and into the central passageway defined by the frame while the frame is in the second configuration. Another step 312 comprises moving the frame of the decorative system from the second configuration to the first configuration such that the decorative element is releasably attached to the support structure.

Step 302 can be accomplished by obtaining any suitable decorative system according to an embodiment, such as decorative system 10.

Step 304 can be accomplished by selecting any suitable support structure and selection of a suitable support structure can be based on various considerations, such as the type of decorative system being used. Examples of support structures considered suitable to attach a decorative system, such as those described herein, include vertical supports, such as posts, lamp posts, mail box posts, and tree trunks, horizontal supports, such as branches, railings, and hand railings, and any other support structures considered suitable for a particular embodiment.

Step 306 can be accomplished by applying a force on the decorative system directed toward the support structure.

Step 308 can be accomplished by applying a force on the frame such that the frame moves from the first configuration in which the slot defines a first width to the second configuration in which the slot defines a second width that is greater than the first width.

Step 310 can be accomplished by applying a force on the decorative system directed toward the support structure while the frame is in the second configuration.

Step 312 can be accomplished by removing the force being applied on the frame (e.g., in step 308) such that the frame moves from the second configuration in which the slot defines the second width to the first configuration in which the slot defines the first width that is less than the second width. This step accomplishes releasable attachment of the decorative system to the support structure.

Depending on the type of elongated decorative elements included on the decorative system, an optional step comprises plugging the elongated decorative element into a power source.

A decorative system can be left on a support structure for any suitable period of time. When desired, the decorative system can be removed from the support structure. This can be accomplished by: unplugging the elongated decorative element from the power source (if used); moving the frame of the decorative system from the first configuration to the second configuration; passing the support structure through the slot and out of the central passageway defined by the frame while the frame is in the second configuration; and moving the frame of the decorative system from the second configuration to the first configuration.

Those with ordinary skill in the art will appreciate that various modifications and alternatives for the described and illustrated examples can be developed in light of the overall teachings of the disclosure, and that the various elements and features of one example described and illustrated herein can be combined with various elements and features of another example without departing from the scope of the invention. Accordingly, the particular arrangement of elements disclosed herein have been selected by the inventor simply to describe and illustrate examples of the invention and are not intended to limit the scope of the invention or its protection, which is to be given the full breadth of the appended claims and any and all equivalents thereof.

What is claimed is:

1. A decorative system comprising:

a frame having a first end, a second end, a length extending from the first end of the frame to the second end of the frame, and a main body defining a slot and a central passageway, each of the slot and the central passageway extending from the first end of the frame to the second end of the frame, the slot providing access to the central passageway, the frame moveable between a first configuration and a second configuration, the slot having a first width when the frame is in the first configuration and a second width when the frame is in the second configuration, the second width being greater than the first width; and a first elongated decorative element attached to the frame, the first elongated decorative element having a first end, a second end, and a length extending from the first end of the first elongated decorative element to the second end of the first elongated decorative element, the length of the first elongated decorative element being greater than the length of the frame.

2. The decorative system of claim 1, wherein a first portion of the first elongated decorative element extends along the length of the frame; and wherein a second portion of the first elongated decorative element extends along the length of the frame.

3. The decorative system of claim 1, wherein the first elongated decorative element extends from the first end of the first elongated decorative element toward the second end of the frame, defines a curve, and extends toward the first end of the frame.

4. The decorative system of claim 1, wherein the first elongated decorative element is attached to the frame in more than one location.

5. The decorative system of claim 1, wherein the first end of the first elongated decorative element is moveable relative to the frame.

6. The decorative system of claim 1, wherein a majority of the length of the first elongated decorative element is disposed on the frame.

7. The decorative system of claim 1, wherein a majority of the length of the first elongated decorative element is disposed between the first end of the frame and the second end of the frame.

8. The decorative system of claim 1, wherein the first elongated decorative element is a strand of garland.

9. The decorative system of claim 8, wherein the frame has an exterior surface, the exterior surface having a first color; and wherein the first elongated decorative element has a second color that is substantially similar to the first color.

10. The decorative system of claim 1, further comprising a second elongated decorative element.

11. The decorative system of claim 10, wherein the second elongated decorative element is a strand of light emitting elements.

12. The decorative system of claim 1, wherein the first width is between about 0.1 inches and about 1.5 inches.

13. The decorative system of claim 1, wherein the frame is a tubular member.

14. The decorative system of claim 1, wherein the frame is formed of PVC.

15. The decorative system of claim 1, wherein the slot has rounded edges.

16. The decorative system of claim 1, wherein the length of the frame is adjustable.

17. The decorative system of claim 16, wherein the frame is telescopic.

18. The decorative system of claim 1, wherein the frame comprises a first portion and a second portion releasably attached to the first portion.

19. A decorative system comprising:

a frame having a first end, a second end, a length extending from the first end of the frame to the second end of the frame, and a main body defining a slot and a central passageway, each of the slot and the central passageway extending from the first end of the frame to the second end of the frame, the slot providing access to the central passageway, the frame moveable between a first configuration and a second configuration, the slot having a first width when the frame is in the first configuration and a second width when the frame is in the second configuration, the second width being greater than the first width; and a first elongated decorative element attached to the frame in more than one location, the first elongated decorative element having a first end, a second end, a length, a first portion, and a second portion, the length of the first elongated decorative element extending from the first end of the first elongated decorative element to the second end of the first elongated decorative element, the length of the first elongated decorative element being greater than the length of the frame when the first elongated decorative element is free of the frame, the first portion of the first elongated decorative element extending along the length of the frame, the second portion of the first elongated decorative element extending along the length of the frame.

20. A decorative system comprising:

a frame having a first end, a second end, a length extending from the first end of the frame to the second end of the frame, and a main body defining a slot and a central passageway, each of the slot and the central passageway extending from the first end of the frame to the second end of the frame, the slot providing access to the central passageway, the frame moveable between a first configuration and a second configuration, the slot having a first width when the frame is in the first configuration and a second width when the frame is in the second configuration, the second width being greater than the first width; and a first elongated decorative element attached to the frame in more than one location, the first elongated decorative element having a first end, a second end, a length, a first portion, and a second portion, the length of the first elongated decorative element extending from the first end of the first elongated decorative element to the second end of the first elongated decorative element, the length of the first elongated decorative element being greater than the length of the frame when the first elongated decorative element is free of the frame, the first portion of the first elongated decorative element extending along the length of the frame, the second portion of the first elongated decorative element extending along the length of the frame, the first elongated decorative element extending from the first end of the first elongated decorative element toward the second end of the frame, defining a curve, and extending toward the first end of the frame, a majority of the length of the first elongated decorative element disposed on the frame.

* * * * *